United States Patent [19]

Milne

[11] Patent Number: 4,750,400

[45] Date of Patent: Jun. 14, 1988

[54] STRINGED MUSICAL INSTRUMENT

[76] Inventor: Paul A. Milne, 706 Beach Lane, Sarnia, Ontario, N7V 2Z2, Canada

[21] Appl. No.: 30,087

[22] Filed: Mar. 26, 1987

[51] Int. Cl.[4] ..... G10H 3/00

[52] U.S. Cl. ..... 84/1.16; 84/1.14

[58] Field of Search ..... 84/1.14, 1.15, 1.16

[56] References Cited

U.S. PATENT DOCUMENTS

| | | | |
|---|---|---|---|
| 3,595,981 | 7/1981 | Hopping | 84/1.16 |
| 4,178,827 | 12/1979 | Mallory | 84/291 |
| 4,242,938 | 1/1981 | van Zalinge | 84/1.16 |

*Primary Examiner*—Patrick R. Salce

*Assistant Examiner*—Jeffrey Sterrett

[57] ABSTRACT

A stringed musical instrument of the solid body or equivalent type is provided with elongated resonant beams which support the bridge for the instrument strings. The resonance of the beams is lowered by the use of concentrated mass portions in or on the beams so that the resonance of the beams will be lowered and with electrical vibration-pickup means a sound more closely resembling that of a hollow bodied instrument will be achieved. The pickups may be crystal, magneto dynamic or other suitable type which are used to produce an electrical signal representative of string induced beam vibration.

8 Claims, 1 Drawing Sheet

STRINGED MUSICAL INSTRUMENT

FIELD OF THE INVENTION

This invention relates to electronically amplified stringed musical instruments and, more particularily to improvements in the tonal rendition of a "solid" bodied guitar. It is known that solid bodied instruments produce weak string sounds without body but, are, nevertheless, used widely in the guitar embodiment where compactness or small size is an asset.

In contrast thereto, it is known that large bodied, acoustic guitars, having hollow bodies, reinforce the string sounds, especially at the lower end of the sound spectrum.

DESCRIPTION OF THE PRIOR ART

U.S. Pat. No. 3,595,981—A. S. Hopping—issued July 27, 1971, shows a stringed musical instrument provided with a plurality of resonant beams resiliently mounted in the body of the instrument and upon which a bridge for the strings is supported. An electronic pick-up device is mounted on the beams to pick up resonant vibrations produced therein by string vibration. The beams are broadly resonant, one beam being supplied for each semitone of the musical scale of the instrument.

A difficulty met with in the musical instrument according to the U. S. patent is that if it is desired to produce low frequency reinforcement of the resultant sound, although this is not mentioned by the patent, the beam cross-section must be reduced to reduce the stiffness of the beams and thus lower their resonant frequencies. This reduction of cross-section reduces the strength of the beams so that sound reinforcement is weak and, furthermore, in order to achieve very low frequency reinforcement, as is desirable for a guitar in particular, the beams may become so weak that the bridge for the strings cannot be adequately supported. If the bridge is located at the area of beam support, an antinodal point, stimulation of vibration of the beams will be a minimum.

ADVANTAGES AND OBJECTS OF THE INVENTION

It is accordingly an object of the present invention to provide a compact stringed musical instrument of substantially solid body construction while, at the same time, providing the needed reinforcement of the lower frequencies to an adequate level by means of resonant beams while still providing adequate strength for bridge support.

It is a further object of the present invention to provide a stringed musical instrument of the compact, hollow or solid body type which, nevertheless, is capable of supplying adequate low frequency sound reinforcement similar to that of larger hollow bodied acoustic type instruments.

It is a still further object of the present invention to provide a compact, stringed musical instrument which is capable of producing both an acoustic and an electronic or string tone.

SUMMARY OF THE INVENTION

In accordance with the present invention two or more resonant beams are provided in a musical instrument, the beams supporting a bridge across which vibratory strings are tensioned. The resonant beams are relatively stiff and strong and provided with concentrated mass portions spaced away from beam supports, which, in combination, produce the desired low frequency resonance desired of the beams and, at the same time are sufficiently strong as to support the bridge away from the beams support in order to achieve good beam vibration stimulation.

A further feature of the present invention is the use of a magnetic (reluctance) type pick-up whereby microphonics are reduced to a minimum. The pole piece of the pick-up is associated with a magnetic plate secured to one of the resonant beams, or a pick-up may be associated with each beam if desired. Further, in accordance with the invention a bridge support may overlie two or more resonant beams and a single pick-up be associated with a magnetic plate attached to the bridge support. It should be realized that although reluctance type pick-ups are to be preferred, it is still possible to achieve good results with, for instance, a crystal type pick-up. A further pick-up device may be used in conjunction with the strings per se in order to produce the usual electric guitar string sound.

DESCRIPTION OF THE DRAWINGS

The invention will now be described in detail with reference to the figures of the drawing in which.

DETAILED DESCRIPTION OF THE INVENTION

Figure 1:
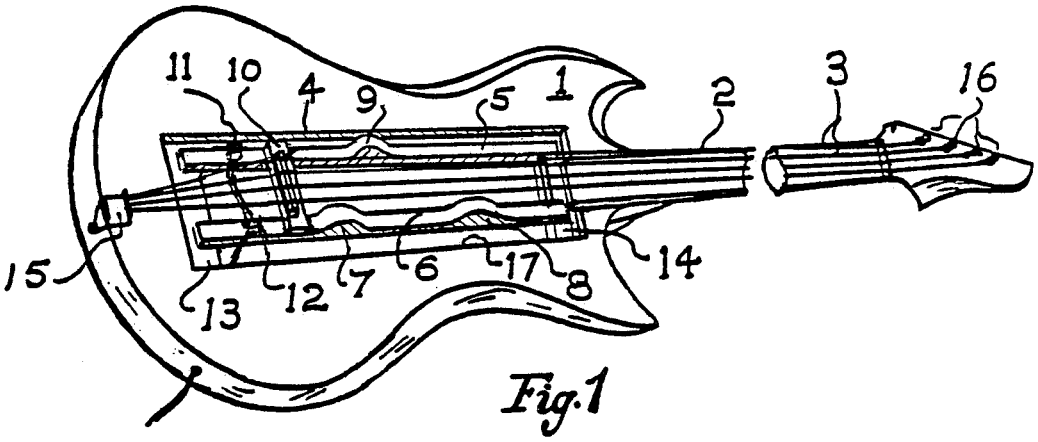
FIG. 1 shows a perspective view of the musical instrument according to the present invention.
Figure 2:
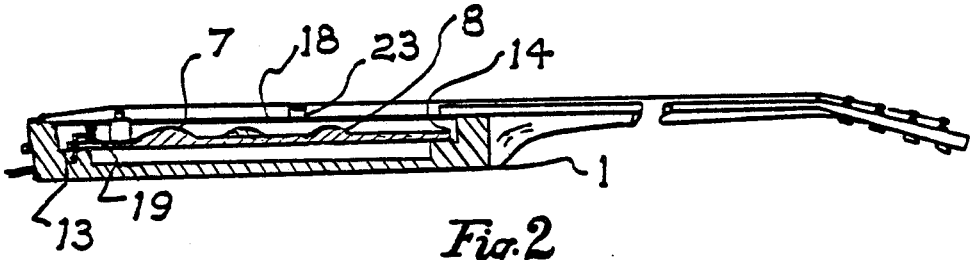
FIG. 2 shows a cross-sectional view of the instrument shown in FIG. 1.

Referring now to FIGS. 1 and 2, the invention will be described in regard to a preferred embodiment thereof. The guitar shown is of the solid body type having a main body 1, a neck 2, strings 3 provided with a supporting bridge 4, the strings being tensioned between a tail-piece 15 and adjustable tensioning pegs or keys 16.

The solid body 1 of the guitar is provided with an elongate, rectangular cut-out portion 17 provided, in turn, at each of its ends with steps 13, 14. Two resonant beams 5, 6 are supported at their ends on the steps 13, 14. A bridge 4 is mounted on and supported by a cross-member 10 overlying the beams 5, 6. The ends of the beams 5, 6 may be secured firmly to steps 13, 14 but it is preferred that they are resiliently secured to or merely rest thereon. Steps 13, 14 may be provided with resilient, but firm surfaces which are helpful in achieving the low resonant frequency desired for beams 5, 6.

Magnetic (reluctance) pick-up devices 11, 12, supported by a cover 18, for cut-out 17, shown in FIG. 2, are each arranged in association with a magnetic plate 19 provided on beams 5, 6, so that any vibration of the beams produce electrical signals which may be amplified and/or modified in a known manner. If it is desired a single pick-up device associated with a magnetic plate, spanning beams 5, 6, may be used for economy reasons. However, using more than one pick-up device allows for adjustment of sound balance which, otherwise, can only be achieved by allowing for lateral adjustment of the pick-up device between the beams 5, 6. A string vibration pick-up device 23, shown mounted on cover 18, is used to produce the normal electrical guitar string sound.

A particular feature of the present invention is the construction of the resonant beams 5, 6. It is known that the resonant frequency of an elongated beam, supported at each of its ends, is defined approximately by the following equation;

$$f = C\sqrt{\frac{EI}{mL^4}}$$

where f is the resonant frequency of the beam, E the modulus of elasticity, m the mass per unit length of the beam and L the total length thereof. The factor C is dependent on the manner in which the beam is supported. With fixed or firmly secured ends C=3.56 whereas with supported but otherwise free ends C=1.57. It will be readily apparent that the "free end" support provides the lowest natural resonant frequency of the beams. The moment of inertia I of the beam will decrease with a decrease in cross-sectional area of the beam while, at the same time, the mass per unit length will also decrease and hence these changes are counteractive, at least to some extent. In addition, a low resonant frequency cannot readily be achieved by the reduction of the cross-sectional area since a minimum strength is required to support the bridge.

According to the invention, the mass of the beam can be artificially increased without greatly affecting the moment of inertia of the beam if the mass is concentrated, for instance, at the center of the length of a beam supported at each end. When concentrated mass portions are provided on the beam the lower resonant frequencies can be obtained without unduly decreasing the cross-sectional area of the beam. The use of concentrated mass portions, according to the invention, results in the possibility of providing support for the bridge away from the beam supports while still achieving the low resonant frequency desired in order to provide a sound effect approaching that of a large acoustic (hollow bodied) instrument. It is a feature of this invention that the bridge is supported away from the beam support in order that the resonance of the beam will be adequately stimulated by string produced vibration of the bridge.

Beam 5 is shown as being provided with one concentrated mass portion 9 adjacent the center thereof with the possibility of achieving single mode vibration of the beam. Beam 6 is provided with two concentrated mass portions 7, 8 with the possibility of achieving multimode vibration in that beam. Other distributions of concentrated mass portions may be employed to produce the resonance effects desired. Indeed several resonant beams having different lengths and distributions of concentrated mass portions may be used to produce a broader range of resonance effects of the instrument. Furthermore, although the beams are shown lying parallel to the length of the instrument they may be placed at an angle thereto. In addition, a single resonant beam could be used to support the bridge, for instance, in the case of a bass violin wherein sufficient length and strength can be readily achieved while maintaining a low resonant frequency.

Figure 3:
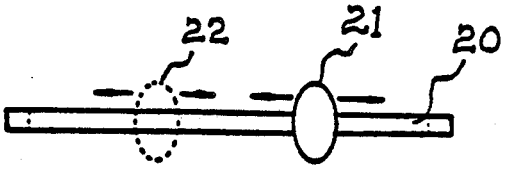
FIG. 3 shows a construction of a resonant beam which allows for adjustment of the resonant frequency thereof.

A further feature of the invention is illustrated in FIG. 3 wherein a resonant beam 20 is shown as being provided with a concentrated mass 21 which is adjustable along the length of the beam to change the resonant frequency or mode of vibration of the composite beam 20, 21. It is further possible to use more than one moveable concentrated mass portion as shown in dotted line 22.

Figure 4:
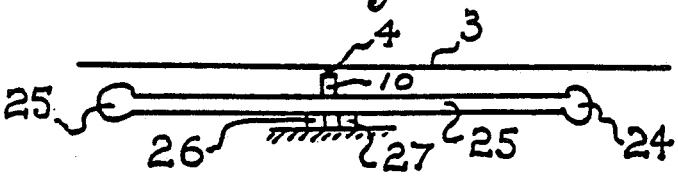
FIG. 4 shows a construction variation in the method of supporting the resonant beams.

Although it is preferred to support the resonant beams at their ends it is within the scope of the invention to support the beams intermediate their ends, for instance, at two closely spaced locations thus freeing the ends of the beams and providing for even lower resonant frequency. In such a construction, as shown in FIG. 4, the bridge can be located between the beam supports.

Although specific embodiments of the invention have been shown and described, the appended claims are intended to cover all embodiments or variations of the invention which fall within the spirit and scope thereof.

I claim:

1. A musical instrument provided with vibratory strings and a bridge therefor supported by at least one resonant, elongated beam located underneath the strings, the said at least one beam being supported for string induced vibration, the beam being provided with a concentrated mass portion at a location therealong displaced from the support for the beam in order to lower the resonant frequency of the beam and pick-up means associated with the said at least one beam and effective to produce an electrical signal representative of vibration of the beam produced therein in response to vibration of the strings.

2. A musical instrument as claimed in claim 1 wherein the pick-up means is of the magnetic reluctance type having pole pieces thereof associated with a magnetic plate secured to at least one of the beams.

3. A musical instrument as claimed in claim 1 wherein the position of the concentrated mass portion is adjustable along the length of the beam.

4. A musical instrument as claimed in claim 1 wherein the instrument is provided with a further pick-up which is associated with the strings in order to produce electrical signals representative of the vibrations of the strings perse.

5. A musical instrument provided with vibratory strings, at least two elongated, resonant beams supported for resonant vibration below the strings, a bridge for the strings mounted on a bridge support lying across the said at least two beams, pick-up signal producing means associated with the beams to produce an electrical signal representative of vibration of the beams, and at least one of the beams being provided with a concentrated mass portion at a location spaced from the beam support location in order to reduce the resonant frequency of the beam and reinforce the low frequency response of the instrument.

6. A musical instrument as claimed in claim 5 wherein the pick-up means is of the magnetic reluctance type having pole pieces thereof associated with a magnetic plate secured to at least one of the beams.

7. A musical instrument as claimed in claim 5 wherein the position of the concentrated mass portion is adjustable along the length of the beam.

8. A musical instrument as claimed in claim 5 wherein the instrument is provided with a further pick-up which is associated with the strings in order to produce electrical signals representative of the vibrations of the strings perse.

* * * * *